US005554049A

United States Patent [19]

Reynolds

[11] Patent Number: 5,554,049

[45] Date of Patent: Sep. 10, 1996

[54] INLINE INDICATING INTERCONNECT

[75] Inventor: Jeffrey Reynolds, Brynmawr, Wales

[73] Assignee: Woodhead Industries, Inc., Northbrook, Ill.

[21] Appl. No.: 109,379

[22] Filed: Aug. 19, 1993

[51] Int. Cl.[6] ..... H01R 13/66

[52] U.S. Cl. ..... 439/490; 439/651; 439/620

[58] Field of Search ..... 439/488, 489, 439/490, 620, 638, 303, 315, 74, 76, 639, 650, 651, 655

[56] References Cited

U.S. PATENT DOCUMENTS

| | | | |
|---|---|---|---|
| 3,281,558 | 10/1966 | Weber | 439/651 |
| 3,295,096 | 12/1966 | Clayton et al. | 439/651 |
| 3,924,914 | 12/1975 | Banner . | |
| 4,111,516 | 9/1978 | Wireman . | |
| 4,258,968 | 3/1981 | Holt | 439/490 |
| 4,368,363 | 1/1983 | Ahuja | 439/620 |
| 4,500,160 | 2/1985 | Bertsch . | |
| 4,571,018 | 2/1986 | Annook | 439/650 |
| 4,927,382 | 5/1990 | Huber | 439/490 |
| 5,007,857 | 4/1991 | Wright | 439/490 |
| 5,062,807 | 11/1991 | Guss, III | 439/490 |
| 5,217,394 | 6/1993 | Ho | 439/620 |
| 5,244,409 | 9/1993 | Guss, III et al. | 439/490 |
| 5,277,620 | 1/1994 | Taylor | 439/488 |
| 5,409,398 | 4/1995 | Chadbourne et al. | 439/490 |

*Primary Examiner*—Daniel W. Howell
*Assistant Examiner*—Hien D. Vu
*Attorney, Agent, or Firm*—Emrich & Dithmar

[57] ABSTRACT

An inline indicating interconnect having a female multi-pin socket connection at a first end and a multi-pin male/male connection and a second, opposed end includes a circuit electrically coupled to and disposed intermediate to the female and male connector ends. The circuit includes at least one light emitting diode (LED) for emitting light when a given electrical condition is satisfied. A generally cylindrical interconnect body comprised of a light-transmissive, moldable material is connected at its respective ends to the female and male connections and overmolded about the circuit components and leads attached thereto so as to encapsulate, seal and provide support for the circuit components and leads while permitting viewing of the emitted light about the entire 360° circumference of the interconnect body. The inline indicating interconnect is particularly adapted for installation in existing cable connections and junctions to provide a visual indication of electrical operation or circuit status.

9 Claims, 2 Drawing Sheets

INLINE INDICATING INTERCONNECT

FIELD OF THE INVENTION

This invention relates generally to interconnects for coupling electrical cables or leads, and is particularly directed to a condition-indicating lighted electrical interconnect which may be easily installed along existing cable runs and junctions.

BACKGROUND OF THE INVENTION

Multi-pole connectors are frequently used with multi-wire cables to connect a source of electrical power to a sensor or component hereafter described as a switch, as well as to establish a control function from a controller to the switch. Additional wires may be used to establish a sensing function at the switch. The sensed function generally provides an indication of a condition such as the application of power to a load. Visual indicators connected in circuit with the connectors may include one or more neon indicating lamps, or light emitting diodes (LEDs), hereafter described as indicators, to provide an indication of signal status or circuit condition. The indicators may be mounted within a connector housing which has internal terminating elements to which are connected the electrical wires of the cable. The housing may have windows or apertures therethrough and the indicators are located adjacent to the windows to be visible from the exterior of the connector. In use, the indicators are lit to indicate conditions, such as the availability of electrical power, and energization of the load.

Although these "lighted connectors" provide the desired indications of power and load status, connectors of this type require manufacturing the connector with apertures to permit viewing of the indicators. Also during assembly, the indicators must be mounted adjacent to the apertures through which they are exposed. Moreover, because the on/off condition of the indicators is provided only on one side of the connector, it may be difficult for a user to determine whether a given condition has been satisfied. Moreover, this type of connector is frequently used in environmental conditions which require sealing against moisture, dust and chemicals. Thus, molded connector heads are frequently used which are opaque and thus incapable of transmitting light to the exterior of the connector head. Finally, these types of indicator connectors require a rewiring of existing systems for installation and are not readily adapted for installation in existing systems.

U.S. Pat. No. 5,062,807, assigned to the assignee of the present application, discloses a lighted, quick-disconnect, right-angle molded electrical connector for connecting a control device or a sensor to a load which includes a lens of light transmissive material for external viewing of a light source within the connector which emits light upon the occurrence of a selected electrical condition. The lens is placed in a suitable mold and the connector body is molded around the lens to form the completed connector assembly. Co-pending application, Ser. No. 07/726,719, filed Jul. 1, 1991, now U.S. Pat. No. 5,244,409, also assigned to the assignee of the present application, discloses a quick disconnect connector assembly for completing an electrical circuit to connect a functional device to a load and for indicating a continuity condition for the electrical circuit. The connector includes a connector body and a molded connector head, a multi-conductor cable including a plurality of electrical conductors, and indicating circuit means including at least one light source energizable for indicating the continuity condition. The molded connector head encloses neon lamps or LEDs and is comprised of a translucent material to permit light emitted by the light source which is disposed within the translucent body to be viewed.

SUMMARY OF THE INVENTION

This invention addresses the aforementioned limitations of the prior art by providing an inline indicating interconnect which is adapted for easy connection at various locations along cable runs and junctions for providing a visual indication of a given electrical condition. The interconnect includes first and second connector bodies respectively adapted for connection to conventional male and female connectors of the conductive pin and socket type with threaded mechanical couplers. An indicator circuit is electrically coupled to the first and second connector bodies and includes at least one light source such as of the LED type which may be disposed on a circuit board and energizable for emitting light when the given electrical condition is satisfied. The inline indicating interconnect further includes a generally cylindrical body coupled to the first and second connector bodies and comprised of a light-transmissive, moldable material for securely coupling the two connector bodies. The interconnect body is molded around the circuit board so as to encapsulate and support the circuit board and to permit viewing of light emitted by the light source around the entire lateral periphery of the interconnect body. The circuit board and light source as well as other circuitry on the circuit board are encapsulated and sealed within and supported by the interconnect body which may be comprised of a clear polyvinyl chloride (PVC) elastomer or similar material. The inline indicating interconnect allows for plug-in circuit testing to determine such conditions as the application of power and the performance of various functions and may be retrofit to existing conventional connectors, avoiding the downtime and expense of hard wiring LED-style connectors in circuit.

These objects of the present invention are achieved and the disadvantages of the prior art are eliminated by an inline indicating interconnect for electrically coupling a first male and a second female connector in completing an electrical circuit to connect a functional device to a load, and for indicating a continuity condition for the electrical circuit, said interconnect comprising: a first connector body coupled to said first male connector; a second connector body coupled to said second female connector; indicator circuit means electrically coupled to said first and second connector bodies, said indicator circuit means including at least one light source energizable for emitting light when said continuity condition is satisfied; and an interconnect body coupled to said first and second connector bodies and comprised of a molded light-transmissive material, wherein said interconnect body is molded about said indicator circuit means so as to encapsulate and support said indicator circuit means and to permit viewing of light emitted by said light source.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1A:
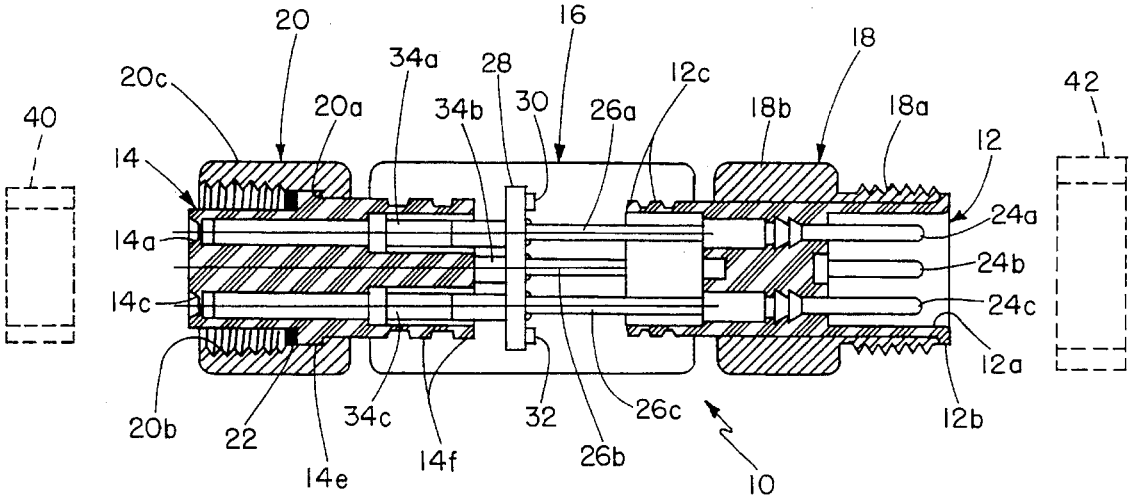
FIG. 1*a* is a longitudinal sectional view of an inline indicating interconnect in accordance with the principles of the present invention.

Referring to FIG. 1*a*, there is shown a longitudinal sectional view of an inline indicating interconnect 10 in accordance with the principles of the present invention. Interconnect 10 is generally cylindrical and includes a first male connector body 12, a second female connector body 14, and a light-transmissive interconnect body 16 coupling the first and second connector bodies. In the exemplary embodiment, interconnect 10 is a four-pole connector and includes four conductors as described below, although the interconnect is not limited to this wiring configuration and may include virtually any wiring arrangement.

Figure 1B:
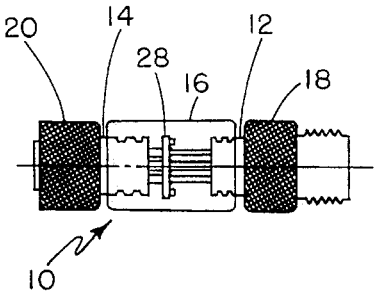
FIG. 1*b* is a side elevation view of the inventive inline indicating interconnect.

Referring to FIG. 1*a* as well as to FIG. 1*b*, which is a side elevation view of the inline indicating interconnect 10, the interconnect includes on one end a male coupling nut 18 disposed about the first male connector body 12 and a female coupling nut 20 disposed about the second female connector body 14. Disposed intermediate and coupling the first male and second female connector bodies 12, 14 is the light-transmissive interconnect body 16 which is shown as including a disc-like printed circuit board (PCB) 28 therein. Although the invention described herein is shown as including PCB 28 disposed between and electrically coupling the male and female connector bodies 12, 14, the invention does not require a circuit board in the electrical circuitry coupling the two connector bodies.

Figure 2:
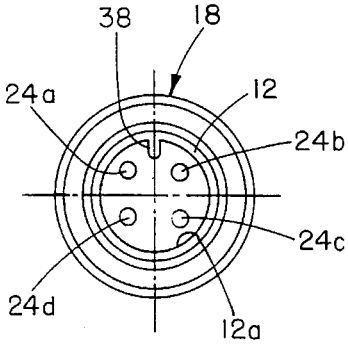
FIGS. 2 and 3 are end-on views of respective opposed first and second end portions of the inline indicating interconnect of FIGS. 1*a* and 1*b;*
Figure 3:
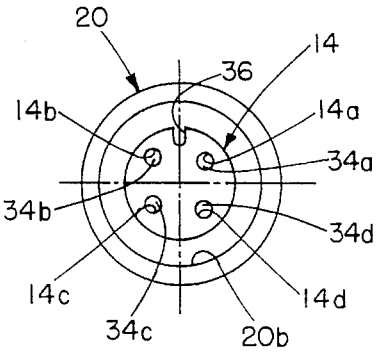

Referring to FIGS. 1*a* and 1*b* as well as to the end-on views of FIGS. 2 and 3, additional details of the inline indicating interconnect 10 will now be described. The first male connector body 12 includes an end aperture 12*a*, an outer lip or edge 12*b*, and a plurality of spaced ribs or annular projections

12*c*. Disposed within the connector body's end aperture 12*a* are first, second, third and fourth elongated, linear conductive pins 24*a*, 24*b*, 24*c* and 24*d*. Disposed about the lateral periphery of the first male connector body 12 is the male coupling nut 18. Male coupling nut 18 includes an outer threaded portion 18*a* and an outer knurled portion 18*b*. Male coupling nut 18 is freely rotatable about the first male connector body 12. The coupling nut's threaded portion 18*a* is adapted for threaded engagement with a female electrical connector 42, shown in the figure in dotted-line form. The coupling nut's outer knurled portion 18*b* facilitates rotational displacement of the coupling nut 18 for connecting it to the female electrical connector 42. The connector body's outer lip 12*b* provides a retaining surface for maintaining the male coupling nut 18 securely in position on the first male connector body 12. Ribs 12*c* on the inner end portion of the first male connector body 12 maintain the connector body in secure engagement with the light-transmissive interconnect body 16.

At the other end of interconnect 10, the second female connector body 14 includes first, second, third and fourth end bores or channels 14*a*, 14*b*, 14*c* and 14*d*. Disposed within each of the first, second, third and fourth end bores 14*a*, 14*b*, 14*c* and 14*d* are first, second, third and fourth conductive socket contacts or terminals 34*a*, 34*b*, 34*c* and 34*d*, respectively. Disposed on the inner end portion of the second female connector body 14 are a plurality of spaced annular ribs 14*f* for securely engaging an inner portion of the light-transmissive interconnect body 16 and maintaining these two components securely connected together. Disposed upon and freely rotatable about the second female connector body 14 is a female coupling nut 20. Female coupling nut 20 is retained on the second female connector body 14 by means of an annular projection 14*e* on the connector body which engages an inner shoulder 20*a* of the female coupling nut preventing the female coupling nut from being removed. Female coupling nut 20 further includes an inner threaded portion 20*b* and an outer knurled portion 20*c* to facilitate rotational displacement of the coupling nut. Inner threaded portion 20*b* is adapted to receive a complementary outer threaded portion of a male electrical connector 40, shown in FIG. 1*a* in dotted-line form. An O-ring 22 disposed within female coupling nut 20 and concentrically disposed about the second female connector body 14 is positioned in contact with the connector body's annular projection 14*e*. O-ring 22 is adapted for positioning between the connector body's annular projection 14*e* and an adjacent portion of the male electrical connector 40 for providing a tight-fitting, sealed connection between the second female connector body 14, female coupling nut 20, and male electrical connector 40.

The first male and second female connector bodies 12, 14 are preferably comprised of a high strength, non-conductive plastic, while male and female coupling nuts 18, 20 are preferably comprised of metal or plastic. As shown in the end view of FIG. 2, the first male connector body 12 includes an inwardly directed keying projection 38 to ensure proper coupling of the first, second, third and fourth conductive pins 24*a*, 24*b*, 24*c* and 24*d* to the corresponding socket contacts (not shown) in the female electrical connector 42. Similarly, as shown in the end view of FIG. 3, the second female connector body 14 includes a keying slot 36 in an outer surface thereof for ensuring proper connection of the first, second, third and fourth conductive socket contacts 34*a*, 34*b*, 34*c* and 34*d* to the corresponding pins (not shown) of the male electrical connector 40. The first male connector body 12 and male coupling nut 18 as well as the second female connector body 14 and female coupling nut 20 permit the inline indicating interconnect 10 to be easily retrofit in existing cable connections and junctions by coupling to conventional connectors.

In accordance with the present invention, the light-transmissive interconnect body 16 is disposed intermediate and securely coupled to the first male and second female connector bodies 12, 14. Interconnect body 16 may be comprised of a moldable, clear polyvinyl chloride (PVC), or similar material. Disposed within the interconnect body 16 is the disc-like PCB 28 having circuitry thereon including first and second light emitting diodes (LEDs) 30 and 32. The first and second LEDs 30, 32 are of different colors and are coupled to appropriate circuitry on PCB 28 which is not shown in FIG. 1*a* for simplicity, but which is described in detail below. The first LED 30, which in the disclosed embodiment is the color green, provides an indication of a first electrical condition such as a "power available" condition. The second LED 32, which in the disclosed embodiment is the color amber, provides an indication of a second electrical condition such as a "power on" condition. The first, second, third and fourth socket contacts 34*a*, 34*b*, 34*c* and 34*d* extend through the second female connector body 14, with their respective inner ends attached to PCB 28 to allow the PCB to be mounted directly to the female connector body. The first, second, third and fourth conductive pins 24*a*, 24*b*, 24*c* and 24*d* within the first male connector body 12 are connected to the PCB 28 by means of respective tinned copper wires to complete the circuit through the inline indicating interconnect 10. Only three of these tinned copper wires 26*a*, 26*b* and 26*c* are shown in the figures for simplicity. Interconnect body 16 is molded over the four socket contacts 34*a*, 34*b*, 34*c* and 34*d*, the four tinned copper wires 26*a*, 26*b* and 26*c* (with the fourth not shown), PCB 28 and the facing end portions of the first male connector body 12 and the second female connector body 14.

Figure 4:
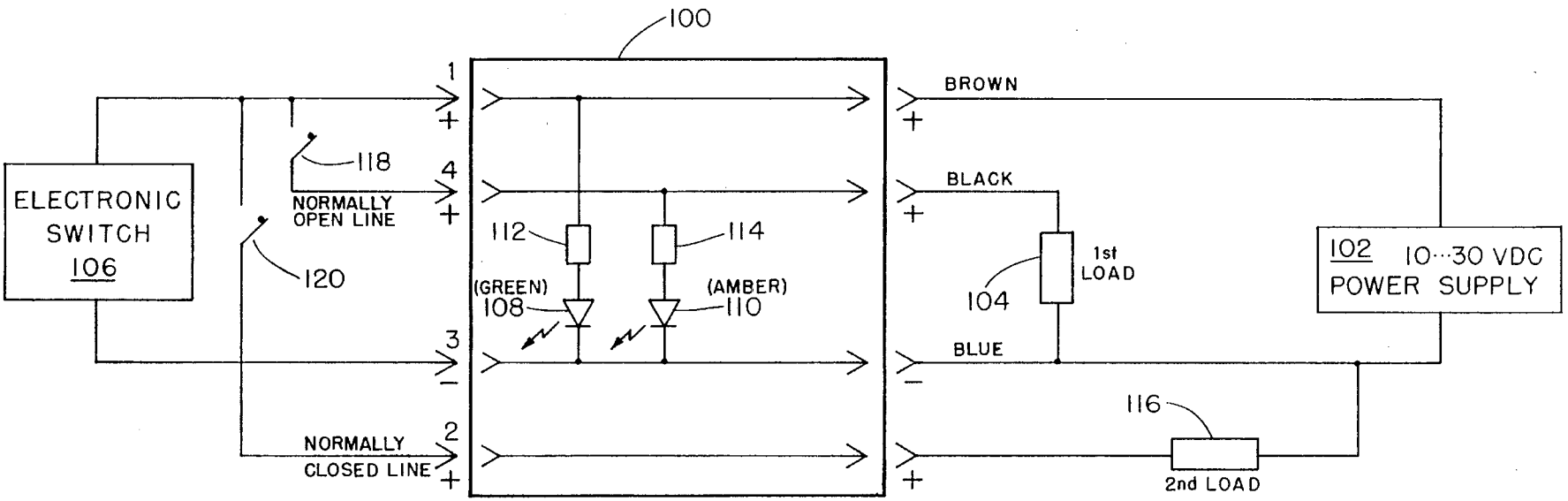
FIG. 4 is a schematic circuit diagram of the inline indicating interconnect illustrating an application for connecting a control device to a load for applying power to the load.

Referring to FIG. 4, there is shown a schematic circuit diagram of an indicating circuit 100 for use in one embodiment of the inline indicating interconnect of the present invention. Although the indicating circuit 100 is in the form of a four wire interconnect, the present invention is not limited to this configuration and will work equally as well with various other numbers of wires. Indicating circuit 100 is coupled to a DC voltage power supply 102 which may range in value from 10 to 30 VDC. A first load 104 is coupled between indicating circuit 100 and the DC power supply 102 to provide an indication to a controller (not shown for simplicity) that an event has occurred. For example, the first load 104 may provide an output to the controller when the presence of an object is detected by a proximity sensor. A second load 116 is also coupled between indicating circuit 100 and DC power supply 102 to provide an indication to the controller of the non-occurrence of an event, such as the absence of detection of an object by the proximity sensor. The proximity sensor may include an electronic switch 106 also shown coupled to indicating circuit 100 by means of first and second switches 118 and 120. Switches 118 and 120 may typically be incorporated in electronic switch 106, but for purposes of illustration are shown in FIG. 4 as separate from the electronic switch.

Figure 4A:
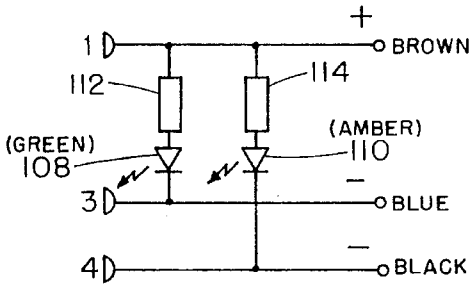
FIG. 4*a* is a schematic circuit design illustrating another indicator coupling arrangement for an NPN format for use in another embodiment of the present invention.

Indicating circuit 100 includes connecting pins 1, 2, 3 and 4 as well as a first combination of a first LED 108 and resistor 112 and a second combination of a second LED 110 and resistor 114. The first switch 118 is normally open, while the second switch 120 is normally closed as shown in the figure. The LED configuration shown in FIG. 4 is for a PNP type transistor output from electronic switch 106, while a complementary LED arrangement for an NPN transistor output is shown in FIG. 4*a*.

In the arrangement of FIG. 4, pins 4 and 2 of indicating circuit 100 are switched. The first load 104 is coupled between pins 3 and 4 and is further coupled to the negative side of the DC power supply 102. When power is applied to electronic switch 106, switch 118 is open and switch 120 is closed. A DC voltage is thus applied to the first LED 108 which emits a green light. With the first LED 108 rendered conductive, a soft green glow is imparted to the light-transmissive interconnect body 16 to indicate that power is available for the electronic switch 106. When the electronic switch 106 is actuated indicating detection of an object, the normally open first switch 118 is closed and the normally closed second switch 120 is opened resulting in a voltage being applied across the second diode 110. When the second diode 110 is rendered conductive, it emits an amber light which is visible through the light-transmissive interconnect body 16. In this manner, the first LED 108 provides an indication of a first condition such as the application of power to the electronic switch 106, while the second LED 110 provides a visual indication of the occurrence of a second condition such as the detection of the presence of an object by the electronic switch 106.

There has thus been shown an inline indicating interconnect having a first female multi-pin socket connection at a first end and a second multi-pin male/male connection at a second, opposed end. Disposed intermediate the first and second end connections is a PCB which is electrically coupled to the end connections by suitable conductive pins and tinned copper wires. Disposed on the PCB is circuitry for driving at least one LED. The LED is turned on when a given electrical condition such as "power available" is satisfied. A second LED having a different color may be provided to indicate that a second electrical condition such as "power on" is provided. A generally cylindrical interconnect body comprised of a molded light-transmissive material connected at respective ends to the female and male connections and overmolded about the PCB and electrical leads attached thereto encapsulates and seals the electrical components and provides support for the PCB and leads while securely coupling the opposed end connections. The light-transmissive interconnect body permits viewing of the emitted light about its entire 360° lateral periphery and is particularly adapted for installation in existing cable connections and junctions to provide a visual indication of electrical operation.

While particular embodiments of the present invention have been shown and described, it will be obvious to those skilled in the art that changes and modifications may be made without departing from the-invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An inline indicating interconnect for electrically coupling a first male and a second female connector in completing an electrical circuit to connect a functional device to a load, and for indicating a continuity condition for the electrical circuit, said interconnect comprising:

a first connector body including a first end portion having a rotatable threaded portion for coupling to said first male connector and further including a second cylindrical end portion;

a second connector body including a first end portion having a rotatable threaded portion for coupling to said second female connector and further including a second cylindrical end portion;

indicator circuit means electrically coupled to said first and second connector bodies, said indicator circuit means including a disc-shaped circuit board having circuitry disposed on a generally flat surface thereof and coupled to a light source, said indicator circuit means further including said light source mounted to said circuit board and energizable for emitting light when said continuity condition is satisfied; and an interconnect body coupled to said first and second connector bodies and comprised of a molded light-transmissive material, wherein said interconnect body is molded about said indicator circuit means so as to encapsulate and support said indicator circuit means and to permit viewing of light emitted by said light source, wherein said interconnect body is generally cylindrical and includes first and second opposed open ends respectively adapted to receive in tight-fitting engagement the cylindrical end portions of said first and second connector bodies, and wherein each of said cylindrical end portions of said first and second connector bodies includes a respective plurality of spaced, annular ribs disposed thereabout for securely attaching said connector bodies to said interconnect body.

2. An inline indicating interconnect as recited in claim 1 wherein said interconnect body is comprised of clear polyvinyl chloride (PVC).

3. An inline indicating interconnect as recited in claim 1 wherein said first connector body includes a plurality of conductive socket contacts coupled to said indicator circuit means.

4. An inline indicating interconnect as recited in claim 1 wherein said second connector body includes a plurality of conductive pins coupled to said circuit means.

5. An inline indicating interconnect as recited in claim 1 wherein said light source is a light emitting diode (LED).

6. An inline indicating interconnect as recited in claim 1 wherein said moldable material is rigid to provide a high strength, secure, sealed connection between said first and second connector bodies.

7. An inline indicating interconnect as recited in claim 1 wherein said indicator circuit means includes a second light source for emitting light when a second condition is satisfied, and wherein said light sources respectively emit first and second light colors.

8. The inline indicating interconnect of claim 7 wherein said light sources are light emitting diodes (LEDs).

9. An inline indicating interconnect as recited in claim 8 wherein said colors are green and amber.

* * * * *